US009113704B2

(12) United States Patent
Hewitt

(10) Patent No.: US 9,113,704 B2
(45) Date of Patent: Aug. 25, 2015

(54) LOCKERS

(75) Inventor: Stephan Hewitt, Yatala (AU)

(73) Assignee: FSP HOLDINGS PTY. LTD., Singleton, NSW (AU)

( * ) Notice: Subject to any disclaimer, the term of this patent is extended or adjusted under 35 U.S.C. 154(b) by 0 days.

(21) Appl. No.: 14/235,906

(22) PCT Filed: Jul. 27, 2012

(86) PCT No.: PCT/AU2012/000896

§ 371 (c)(1),
(2), (4) Date: Feb. 19, 2014

(87) PCT Pub. No.: WO2013/016763

PCT Pub. Date: Feb. 7, 2013

(65) Prior Publication Data

US 2014/0191631 A1 Jul. 10, 2014

(30) Foreign Application Priority Data

Jul. 29, 2011 (AU) ..... 2011903047

(51) Int. Cl.

*A47B 96/00* (2006.01)
*A47B 47/00* (2006.01)
*A47B 61/00* (2006.01)

(52) U.S. Cl.

CPC ..... *A47B 47/00* (2013.01); *A47B 61/00* (2013.01)

(58) Field of Classification Search

CPC .. A47B 47/00; A47B 47/047; A47B 47/0091; A47B 61/00; A47B 81/00; A47B 96/00; B29C 41/04; B29C 41/06; B29C 41/085

USPC ..... 312/257.1, 107, 108, 111, 263, 265.5, 312/265.6, 351, 350; 211/189, 194; 29/527.1

See application file for complete search history.

(56) References Cited

U.S. PATENT DOCUMENTS 3,552,817 A * 1/1971 Marcolongo ..... 312/107
3,712,697 A 1/1973 Kelley et al.
3,999,818 A * 12/1976 Schankler ..... 312/111

(Continued)

FOREIGN PATENT DOCUMENTS

FR 2832300 5/2003
GB 1 398 744 6/1975

OTHER PUBLICATIONS

International Search Report for PCT/AU/2012/000896; completion date Sep. 27, 2012; 3 pages.

*Primary Examiner* — James O Hansen

(57) ABSTRACT

A method of making a locker (10) uses a cabinet (20) having a rear wall, a top (24), a base and opposed side walls (22). The side walls defining support means (40) for supporting and preferably engaging the side edges of a shelf or cabinet divider, projecting into the cabinet. The cabinet (20) is configured to receive a door (12, 14, 16) mounted to one side of the cabinet by means of a hinge arrangement. The hinge arrangement includes one or more knuckles (30) defined on the door, and a series of projections (32) extending along the one side of the cabinet, spaces being defined between the projections (32) for receiving a knuckle (30) of a door therebetween. The support means (40) are defined adjacent the projections (32) and between the recesses moulded. The cabinet is moulded with a closed front face and the front face is selectively removed to define one or more apertures. Next one or more dividers or shelves is/are inserted into the cabinet as required and one or more doors are attached to the cabinet.

8 Claims, 7 Drawing Sheets

(56) References Cited

U.S. PATENT DOCUMENTS

| | | | | | |
|---|---|---|---|---|---|
| 4,281,883 | A * | 8/1981 | Zacky | ..... | 312/140 |
| 4,826,265 | A * | 5/1989 | Hockenberry | ..... | 312/326 |
| 5,372,415 | A * | 12/1994 | Tisbo et al. | ..... | 312/108 |
| 6,099,092 | A * | 8/2000 | Uffner et al. | ..... | 312/108 |
| 7,901,018 | B2 * | 3/2011 | Baughman | ..... | 312/240 |
| 2002/0043905 | A1 * | 4/2002 | Insalaco et al. | ..... | 312/108 |
| 2002/0125799 | A1 * | 9/2002 | Landsberger et al. | ..... | 312/209 |
| 2002/0171332 | A1 * | 11/2002 | Skov et al. | ..... | 312/107 |
| 2008/0074013 | A1 * | 3/2008 | Ahlgrim et al. | ..... | 312/108 |

* cited by examiner

LOCKERS

CROSS-REFERENCE TO RELATED APPLICATIONS

The present application claims priority from Australian patent application No 2011903047 entitled "Improvements in lockers", the content of which is incorporated herein by reference.

FIELD OF THE INVENTION

This invention relates to improvements in lockers, particularly in relation to lockers moulded from a plastics material and to a method of manufacture of such lockers.

BACKGROUND OF THE INVENTION

Lockers are commonly used for the temporary safe storage of a person's possessions, such as valuables, school books, clothes and the like. They are common in many environments, in particular, in schools, in gyms, and particularly in workplaces where people change from everyday clothes into to work uniforms and vice versa.

Lockers can be made from a number of different materials. Metal, wood composites and plastics materials are commonly used in their manufacture. The materials used will vary depending on the application, security requirements, cost factors, such as cost of materials and manufacture, and other factors.

One issue when supplying lockers is that lockers are often provided in different sizes/capacities depending on their intended use, the volume of the material expected to be stored in the locker, the amount of space available at the site and the number of people for whom lockers have to be provided.

Often banks of lockers will be required to include cabinets having different capacities. The need to provide such flexibility in locker capacity, results in increased costs and an increase in the number of parts and components required for providing a range of available locker configurations, particularly in the case of lockers provided from moulded plastics materials.

The present invention aims to provide an improved locker and a method of making lockers which enables the provision of a wide range of locker sizes with a minimum number of components.

Any discussion of documents, acts, materials, devices, articles or the like which has been included in the present specification is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

In a first broad aspect, the present invention provides a locker including a cabinet having a rear wall, a top, a base and opposed side walls, the side walls defining support means for supporting and preferably engaging the side edges of a shelf or cabinet divider, said support means typically projecting into the cabinet wherein the cabinet is configured to receive a door mounted to one side of the cabinet by means of a hinge arrangement, the hinge arrangement including one or more knuckles defined on the door, and a series of projections extending along the one side of the cabinet, spaces being defined between the projections for receiving a knuckle of a door therebetween wherein the means for supporting are defined adjacent the projections and between the spaces.

When complete the locker will include a door and, typically, means for locking the door with a padlock, lock or the like.

Typically, each cabinet will define three sets shelf support means disposed on opposed side walls of the cabinet. Typically, the shelf support means are defined by a pair of projecting ribs extending into the interior of the cabinet with corresponding recesses in the exterior of the cabinet formed as a result of the moulding process.

The present invention may allow the making of lockers of different sizes and configurations using the same cabinet moulding, by judicious insertion of shelves/dividers on the support means and by use of appropriately sized doors, with a consequent increase in flexibility of locker design as well as cost savings during manufacture.

In a preferred embodiment the cabinet of the locker is manufactured in one piece (e.g. by roto-moulding or the like) as a rectangular parallelepiped having six faces with the front of the cabinet closed by means of an integrally moulded plate/sheet of material.

The front sheet is then selectively trimmed/removed depending on the number and size of the lockers to be made from the cabinet. Typically each cabinet can be used to make from one to four lockers, although cabinets allowing greater numbers of sub-divisions are envisaged.

More specifically, to form the locker, one or more apertures are then cut in the sheet of plastic corresponding to the number and size of the doors to be attached to the cabinet.

In one embodiment where the cabinet is to form a full sized locker the entire front sheet is removed apart from an edge portion adjacent the sides, top, and bottom of the cabinet. In embodiments where the cabinet is to be used to form a plurality of lockers, a strip of the front face extending from one side of the cabinet to the other coinciding with the location of a shelf/cabinet divider is left in place.

Once the knuckles of the door or doors are inserted in the recesses, a locking pin is dropped down the side of the cabinet to fix the doors in place.

Advantageously, using the cabinet of the present invention it is possible from a single cabinet shell to form a locker having from one to four separate lockers, each accessible by its own door.

The invention also embraces the cabinet for forming a locker, the cabinet having a rear wall, a top, a base and opposed side walls, the side walls defining support means for supporting and preferably engaging the side edges of a shelf or cabinet divider, said support means typically projecting into the cabinet, wherein the cabinet is configured to receive a door mounted to one side of the cabinet by means of a hinge arrangement, the hinge arrangement including one or more knuckles defined on the door, and a series of projections extending along the one side of the cabinet, spaces being defined between the projections for receiving a knuckle of a door therebetween wherein the means for supporting are defined adjacent the projections and between the spaces.

The invention also embraces a method of making a locker using a cabinet having the features described about moulded with a closed front face and including the steps of:

selectively removing the front face to define one or more apertures;

inserting dividers or shelves as required; and attaching a door to the cabinet.

BRIEF DESCRIPTION OF THE DRAWINGS

A specific embodiment of the present invention will now be described by way of example only, and with reference to the accompanying drawings in which.

DETAILED DESCRIPTION OF A PREFERRED EMBODIMENT

Figure 1:
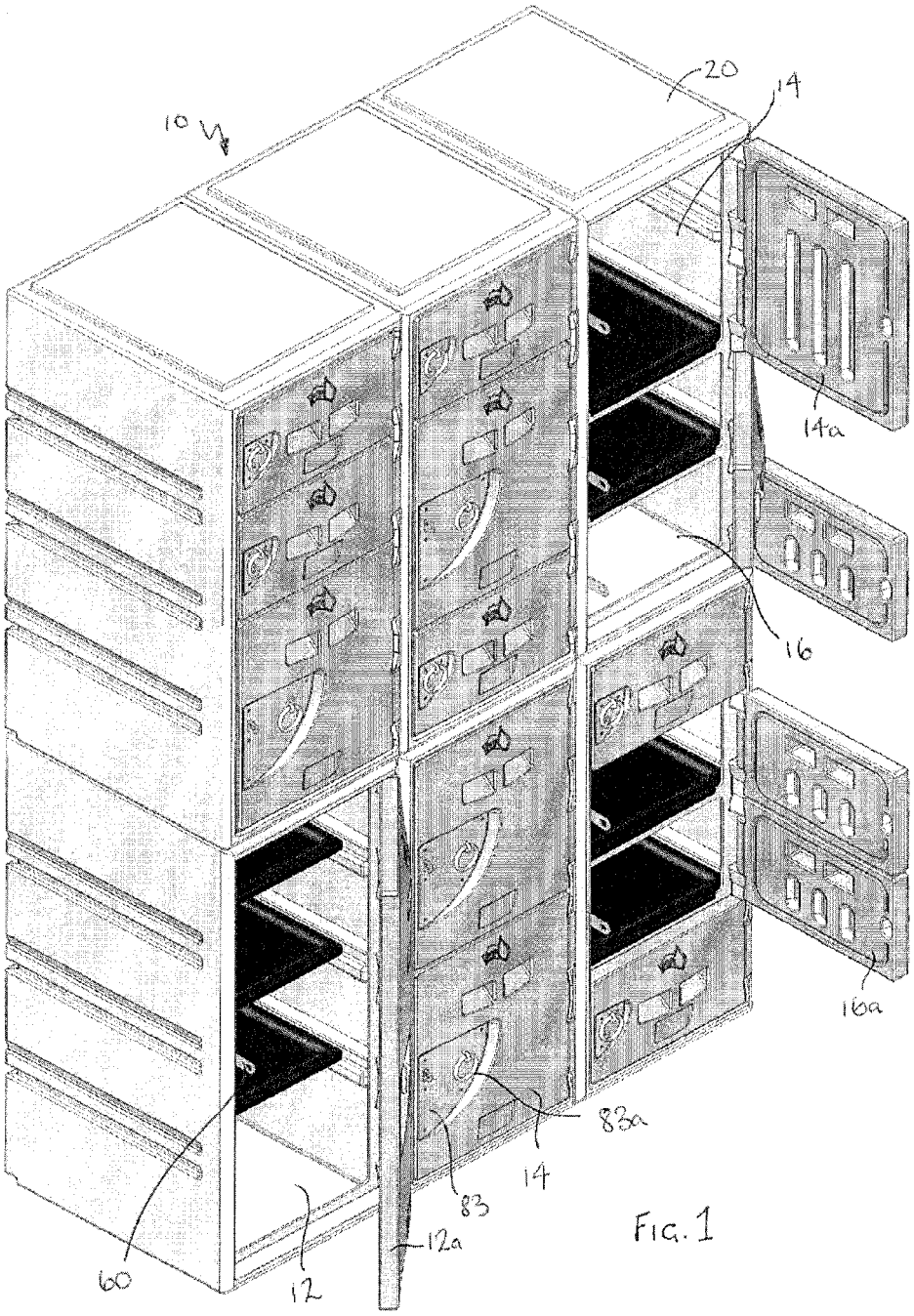
FIG. 1 shows an array of lockers embodying the present invention.

Referring to the drawings, FIG. 1 shows an array 10 of lockers having various sizes and configurations. Some are shown open and some are shown closed. each locker includes an enclosed storage area and a door for closing the same. There are three different sizes of lockers which are hereinafter referred to as full size 12 , half size 14 and quarter size 16, the half size locker being half the size of the full size locker 12, and the quarter size locker 16 being one quarter of the size of a full size locker 12. The lockers have doors 12*a*, 14*a* and 16*a* which are about the same size as the open front of the locker.

Figure 2:
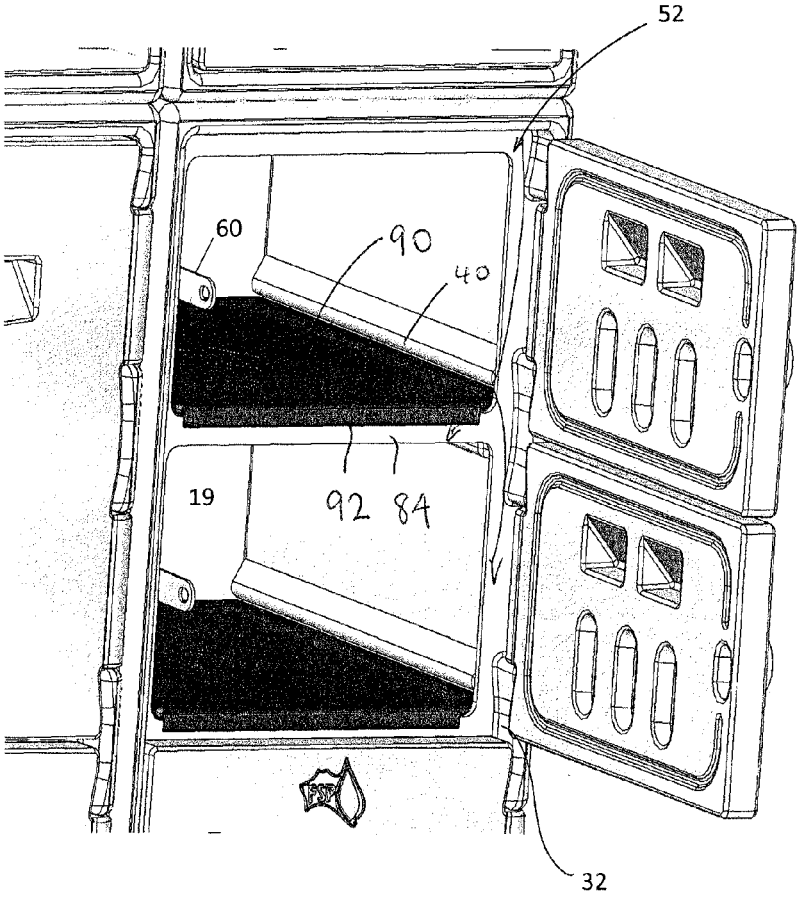
FIG. 2 shows a close up view of part of FIG. 1 showing two of the lockers in the array shown in FIG. 1.
Figure 3:
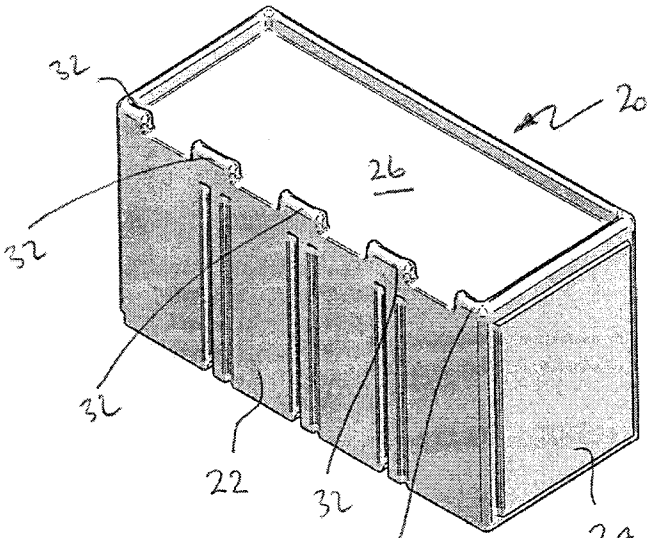
FIG. 3 shows a moulding of a cabinet for the use in forming a locker after moulding.
Figure 6:
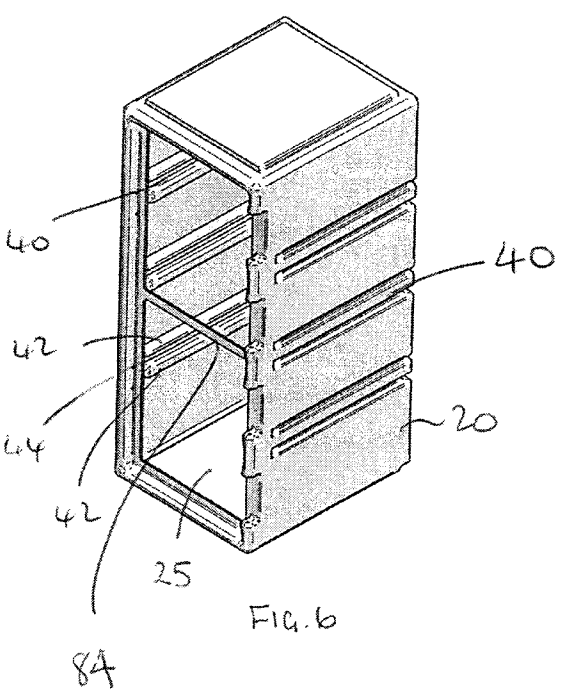
FIG. 6 shows the cabinet of FIG. 3 with a front face trimmed for mounting two half sized doors to the cabinet.
Figure 7:
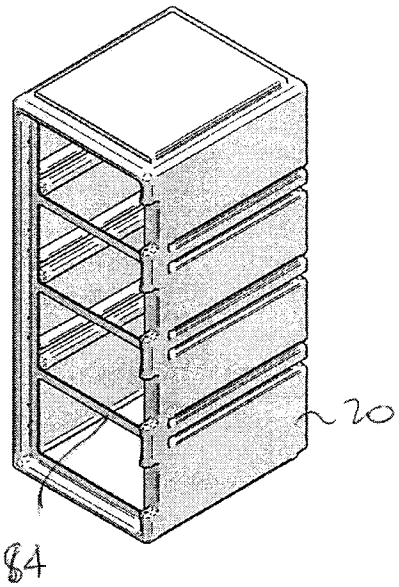
FIG. 7 shows the cabinet of FIG. 3 with a front face trimmed for mounting four quarter sized doors to the cabinet.
Figure 5:
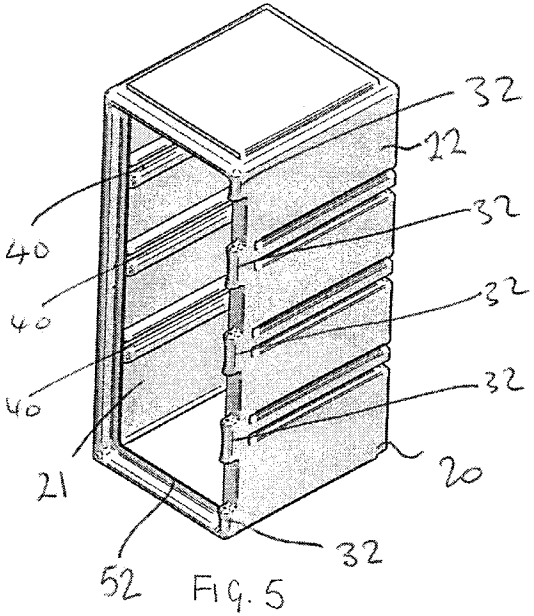
FIG. 5 shows the cabinet of FIG. 3 with a front face trimmed for mounting a single full sized door to the locker.

All the lockers share and are based on the same basic cabinet moulding 20 regardless of their size, which is illustrated in FIG. 3, as moulded and in FIGS. 5 to 7. Each cabinet moulding is moulded with a back 19 (refer to FIG. 2, not visible in FIG. 3), sides 21, 22, top 24, bottom 25 and a solid front face 26. Hence the cabinet 20 is a closed and six sided parallelepiped when it leaves the mould.

Figure 8B:
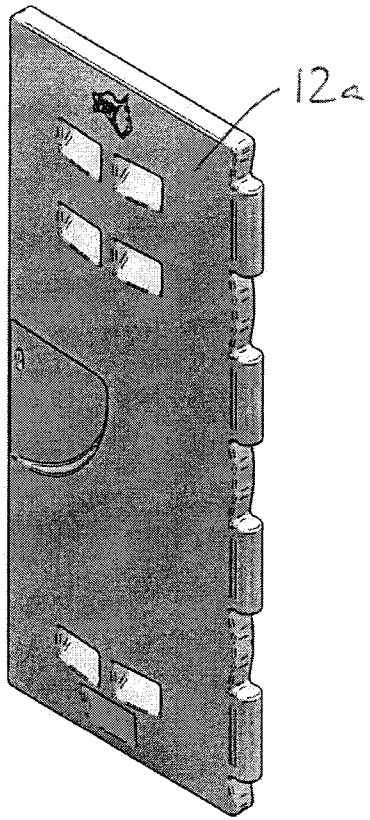
FIGS. 8*a* and 8*b* show a full sized door.
Figure 8A:
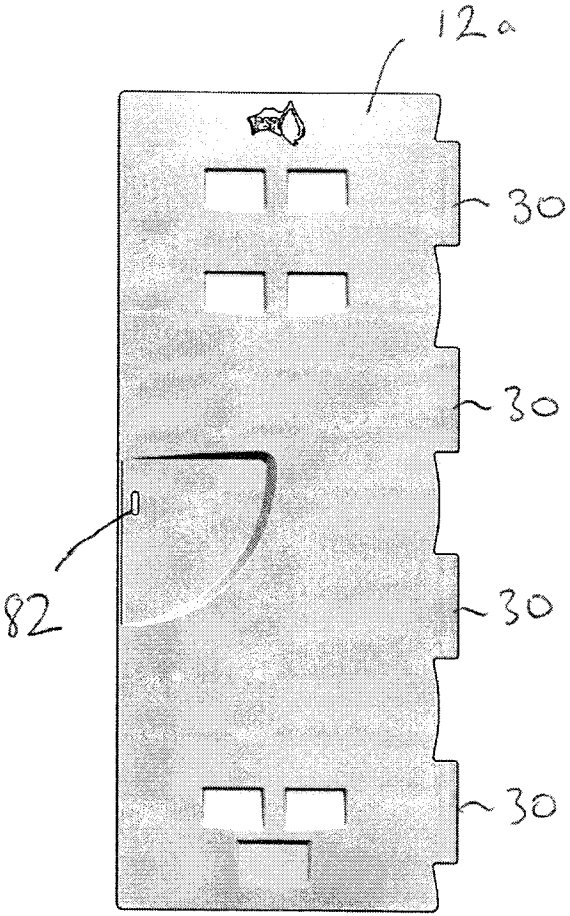
Figure 9B:
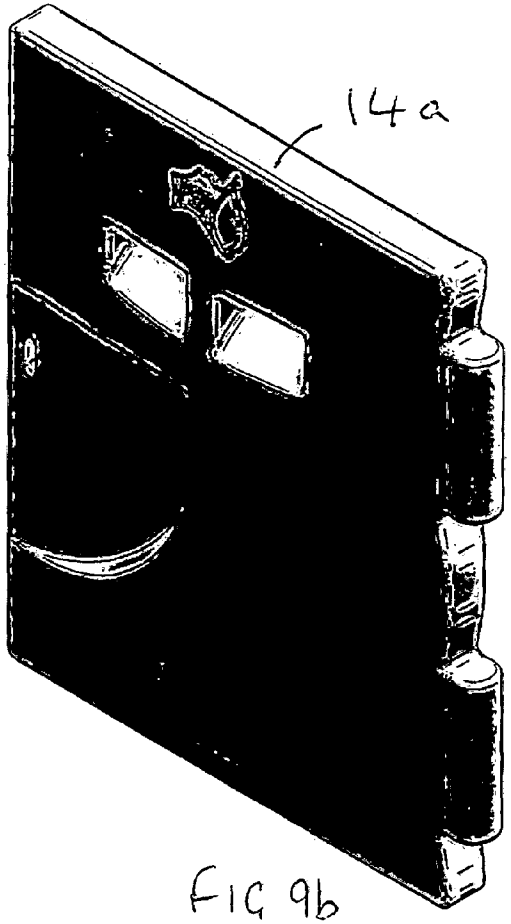
FIGS. 9*a* and 9*b* show a half sized door.
Figure 9A:
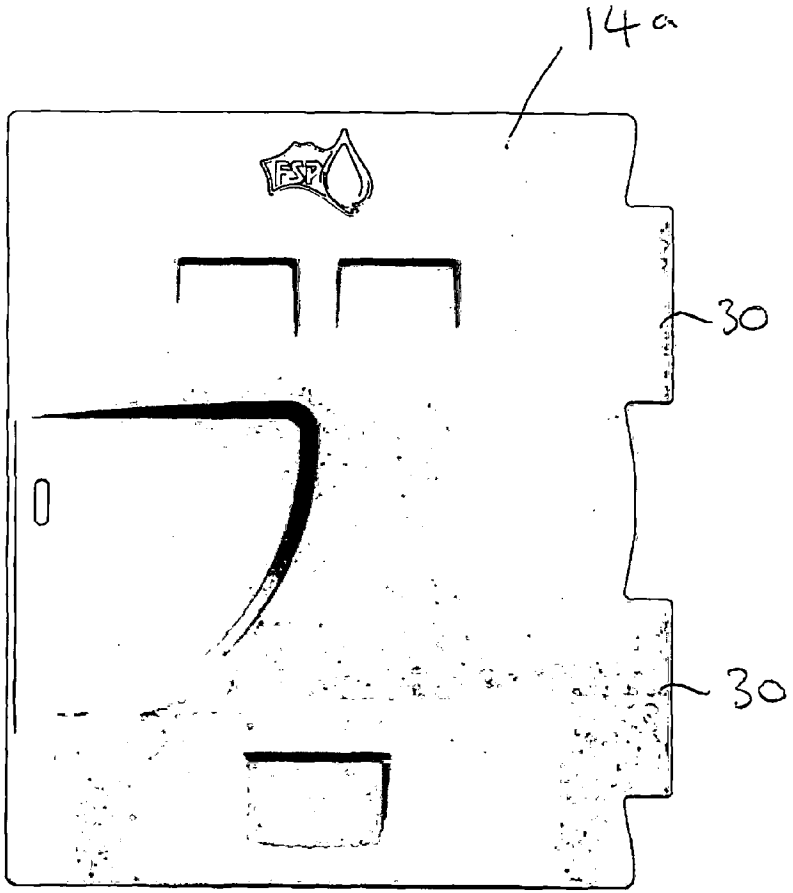
Figure 10B:
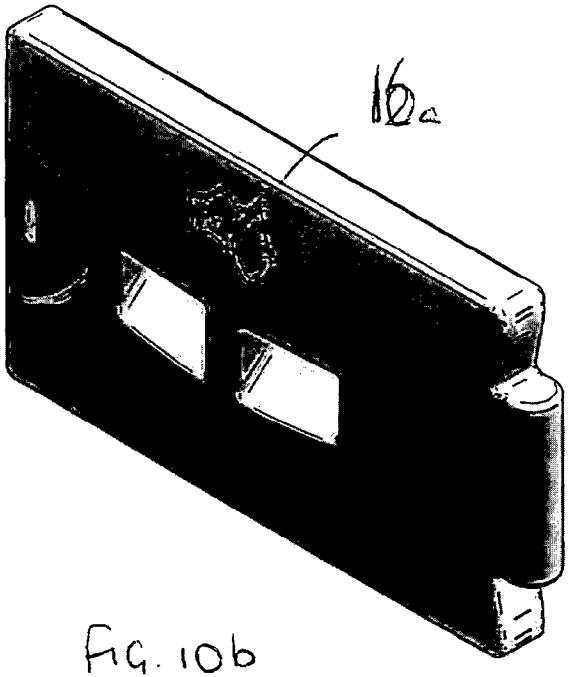
FIGS. 10*a* and 10*b* show a quarter sized door.
Figure 10A:
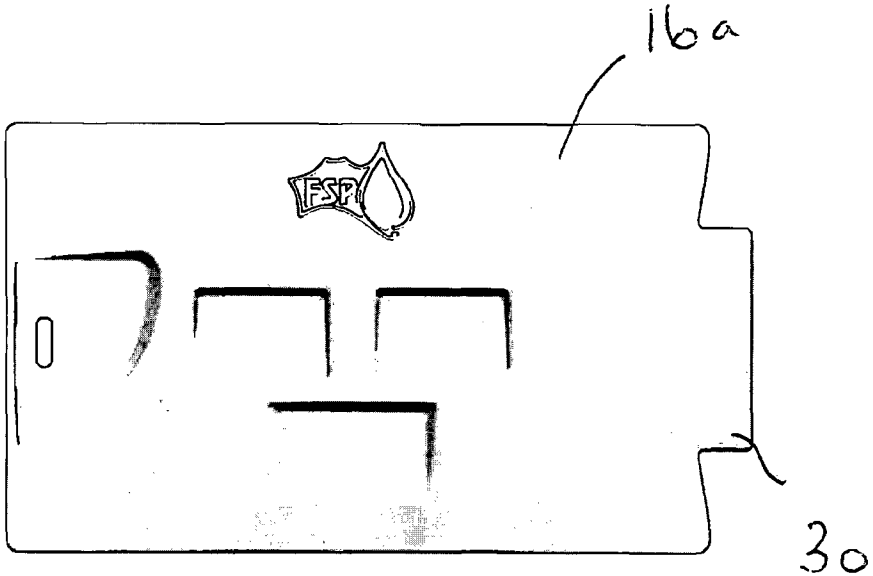

With reference to FIG. 1 and to FIGS. 8 to 10 it can be seen that each door defines at least one knuckle 30 which in use forms part of the hinge for mounting the locker door to the cabinet. Specifically, with reference to FIGS. 8 to 10, the full sized door 12*a* defines four knuckles 30, the half sized door 14*a* defines two knuckles and the quarter sized door defines one knuckle.

With reference to FIG. 3 and also to FIGS. 5 to 7, along the right hand side of the front face there are five spaced projections 32 which, in use, in combination with the knuckles 30 of one or more doors and a hinge pin, define a hinge or hinges attaching a door or doors to the cabinet. An aperture extends through the centre of each of the projections and the knuckles for receiving the hinge pin (not shown).

The spacing or recesses between the projections are about the same size as the knuckles.

Also shown in FIG. 3 and FIGS. 5 to 7 are the shelf/divider support means 40. Each shelf support means comprises a pair of projecting ribs 42 separated by a gap 44 for receiving the side edge of a shelf/divider. The support means are provided at the same height in the cabinet on opposed sides. As can be seen three sets of support means are provided in each cabinet.

In order to assemble a locker using the cabinet of FIG. 3, the front panel 24 is first cut/trimmed according to the size of the door or doors which are to be attached to the cabinet.

For example, with reference to FIG. 5, if the cabinet is to take a single door, one very large rectangular aperture is cut out leaving only the edge 52 of the front plate 26, leaving the perimeter of the front plate extending about 1 to 2 cm around the perimeter of the front of the cabinet as shown in FIG. 5. This perimeter edge acts as a guide/locator, for the door when, closed. A single elongate locking plate 60 defining a hole for receiving a padlock is then attached to the cabinet (refer to FIG. 1). A full sized door 12*a* as shown in FIG. 8 is then attached to the cabinet by aligning the knuckles 30 and recesses 32 along the sides of the cabinet and inserting and fixing a hinge pin passing through the projections 32 and knuckles 30 forming the hinge. The door defines an aperture 82 though which the plate 60 passes for locking the cabinet closed with a padlock or the like. A metal front plate 83 defining a handle 83*a* is fixed to the front of the cabinet, and the locking plate passes through this front plate for improved security.

Figure 4A:
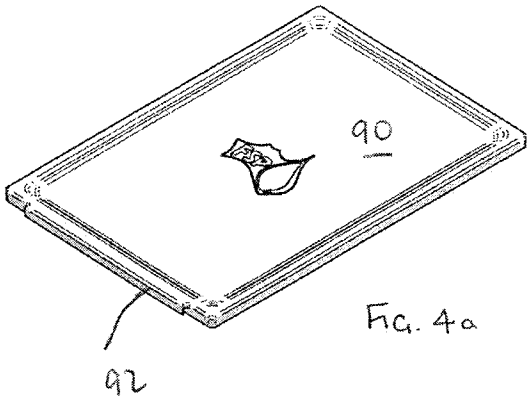
FIGS. 4*a* and 4*b* show a top view and a bottom view respectively of a shelf for use in the cabinet.
Figure 4B:
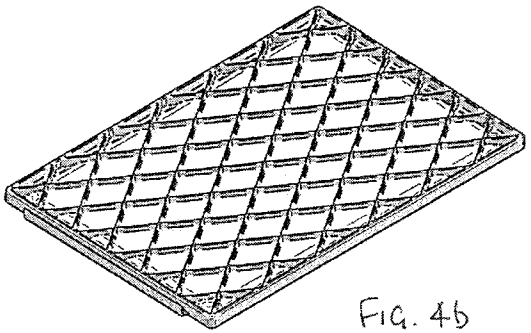

If the cabinet is to be used to form two half-sized lockers, two rectangular apertures are cut in the front face 26 as illustrated in FIG. 6, leaving a strip 84 approximately 1 to 2 cm wide extending between the sides of the cabinet, at the same height as the middle shelf support 40. A divider 90 is then inserted in the cabinet. FIGS. 4*a* and 4*b* illustrate a divider which is a flat plate sized to divide the cabinet into two enclosures, which extends to the front of the cabinet and defines a depending lip 92 at its front which, as can best be seen in FIG. 2, overlies the strip 84. This inhibits removal of the divider.

Locking plates 60 are then fixed to the cabinet midway along the side of each enclosure and two half sized doors 14*a* are mounted simultaneously one above the other using a single hinge pin.

Likewise, if the cabinet is to form a locker having four quarter sized lockers then, as illustrated in FIG. 7, four apertures are cut into the plate separated by three strips 84 of approximately 1 cm wide each at the height of one of the support means 40. Three dividers are inserted to form four enclosures, and four doors 16*a* are hinged to the cabinet using a single hinge pin.

It will be appreciated that it is possible to provide a locker combining a half locker and two quarter locker in various combinations some of which are illustrated in FIG. 1.

It would be appreciated that using the present invention it is possible to make lockers of different sizes and configurations using the same moulding with a consequent increase in flexibility of locker design as well as cost savings during manufacture.

The larger lockers may be provided with shelves which need not extend to the front of the cabinet as their function in that case is not to subdivide the cabinet into separate secure lockers but to provide shelves for storage of items.

The principals and features of the system described above may be used with lockers of differing sizes including cabinets for full length lockers up to 2 to 3 m in height and may be subdivided into a greater number of enclosures/lockers than four.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A method of making a locker comprising the steps:

molding in one piece a closed cabinet, the molded closed cabinet having a rear wall, a top, a base and opposed side walls and an integral closed front wall, wherein the side walls of the original molded cabinet define shelf supports, wherein the cabinet is configured to receive a door mounted to one side of the cabinet by means of a hinge arrangement, the hinge arrangement comprising one or more knuckles defined on the door and a series of projections extending along the one side of the cabinet, spaces being defined between the projections for receiving a knuckle of a door therebetween, wherein the shelf supports are adjacent the projections and between the recesses;

selectively removing the closed front wall to define one or more apertures; and attaching one or more doors to the cabinet, wherein the doors define knuckles and wherein the knuckles of the one or more doors are located between the projections.

2. The method of claim 1 wherein the number of apertures defined in the front face corresponds to the number of doors attached.

3. The method of claim 1 further including the step of inserting one or more dividers or shelves supported on the shelf supports.

4. The method of claim 1 wherein the closed cabinet is formed by roto-molding.

5. The method of claim 2 wherein the step of selectively removing the closed front wall of the cabinet comprises forming a single aperture only, and the step of attaching one or more doors to the cabinet comprises adding a single door.

6. The method of claim 2 wherein the step of selectively removing the closed front wall of the cabinet comprises forming two apertures, and the step of attaching one or more doors to the cabinet comprises adding two doors and including the step of supporting at least one divider on the shelf supports.

7. The method of claim 2 wherein the step of selectively removing the closed front wall of the cabinet comprises forming three apertures, and the step of attaching one or more doors to the cabinet comprises adding three doors and including the step of supporting at least two dividers on the shelf supports.

8. The method of claim 2 wherein the step of selectively removing the closed front wall of the cabinet comprises forming four apertures, and the step of attaching one or more doors to the cabinet comprises adding four doors and including the step of supporting at least three dividers on the shelf supports.

* * * * *